United States Patent [19]

Baumanis

[11] Patent Number: 5,044,986

[45] Date of Patent: Sep. 3, 1991

[54] SEALING DEVICE FOR PANEL MOUNTED ELECTRICAL CONNECTOR

[75] Inventor: Bruno Baumanis, River Forest, Ill.

[73] Assignee: Molex Incorporated, Lisle, Ill.

[21] Appl. No.: 545,562

[22] Filed: Jun. 29, 1990

[51] Int. Cl.[5] ..... H01R 13/73

[52] U.S. Cl. ..... 439/548; 439/556

[58] Field of Search ..... 439/548, 556, 559, 561, 439/587, 588, 471, 464, 271

[56] References Cited

U.S. PATENT DOCUMENTS

| | | | |
|---|---|---|---|
| 1,987,035 | 1/1935 | Tideman | 439/557 X |
| 2,712,120 | 6/1955 | Cochran | 439/556 |
| 3,182,279 | 5/1965 | Gerald | 439/556 |
| 3,497,923 | 3/1970 | Seckerson | 439/557 X |
| 3,941,444 | 3/1976 | Bruni et al. | 439/587 |
| 4,374,604 | 2/1983 | Hemmer et al. | 439/587 |
| 4,500,151 | 2/1985 | Ayers | 439/271 X |
| 4,697,861 | 10/1987 | Mitchell | 439/587 X |

*Primary Examiner*—Larry I. Schwartz
*Assistant Examiner*—Julie R. Daulton
*Attorney, Agent, or Firm*—Louis A. Hecht; Stephen Z. Weiss; Charles S. Cohen

[57] ABSTRACT

A sealing device is provided for closing an opening in a panel which accommodated an electrical connector. The device includes a body positionable about the connector. A sealing flang on the body establishes sealing engagement with the panel about the opening. A positive lock is provided between the body and the connector for holding the sealing device in position with the sealing flange in sealing engagement with the panel.

6 Claims, 1 Drawing Sheet

SEALING DEVICE FOR PANEL MOUNTED ELECTRICAL CONNECTOR

FIELD OF THE INVENTION

This invention generally relates to the art of electrical connectors and, particularly, to a sealing device for closing an opening in a panel which accommodates an electrical connector.

BACKGROUND OF THE INVENTION

There are a wide variety of electrical connectors which are mounted through an opening in a panel and for coupling to a mating connector on a side of the panel opposite the direction of insertion of the connector. In some applications, it is desirable to close and seal the opening in the panel to isolate the inner side of the panel from the outside environment, such as for moisture proofing the arrangement. This often is accomplished simply by grommets which surround the connector and provide a seal between the connector and the edge of the opening in the panel. The grommets may include body portions which surround and also provide protection for the connector itself, such as in the form of a boot.

Some panel mounted connectors also have latch means in the form of latch fingers for retaining the connector at a particular position relative to the opening in the panel Usually, the latch fingers on the connector engage the panel within the opening therethrough. A sealing device, therefore, must accommodate these latch fingers and, consequently, a grommet extending through the opening is impractical. In such applications, a sealing boot may surround the connector on the outside of the panel, with a peripheral sealing flange engaging the outside panel surface about the opening in the panel and surrounding the connector and its latching fingers. The peripheral flange usually is flexible, and one of the problems in using such boots is to provide pressure which will maintain the flexible flange in sealing engagement with the panel surface. This may be accomplished by outside clamps, tape or the like, but such devices may become loosened and slippage occurs resulting in loss of the seal.

This invention is directed to solving the above problems of providing an adequate seal for a panel mounted connector, with new and improved seal-facilitating features.

SUMMARY OF THE INVENTION

An object, therefore, of the invention is to provide a new and improved sealing device for closing an opening in a panel which accommodates an electrical connector.

Generally, the sealing device includes a generally hollow body positionable about the connector, with a peripheral sealing flange on the body for sealing engagement with the panel about the opening. Complementary interengaging means are provided between the body and the connector to provide a positive lock therebetween for holding the sealing device in position with the flange in sealing engagement with the panel.

The sealing device is particularly applicable for use with a connector which includes latch means for engaging the panel at the opening therein. The body of the sealing device is of a size sufficient to accommodate the latch means. Therefore, as the connector is latched to the panel, the positive lock between the sealing device and the connector, in turn, maintains the peripheral sealing flange of the sealing device in good engagement with the panel surface.

Another feature of the sealing device is the provision of a tubular portion for surrounding a cable interconnected with the connector, and including clamp means about the tubular portion for tightening the tubular portion sealingly about the cable.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
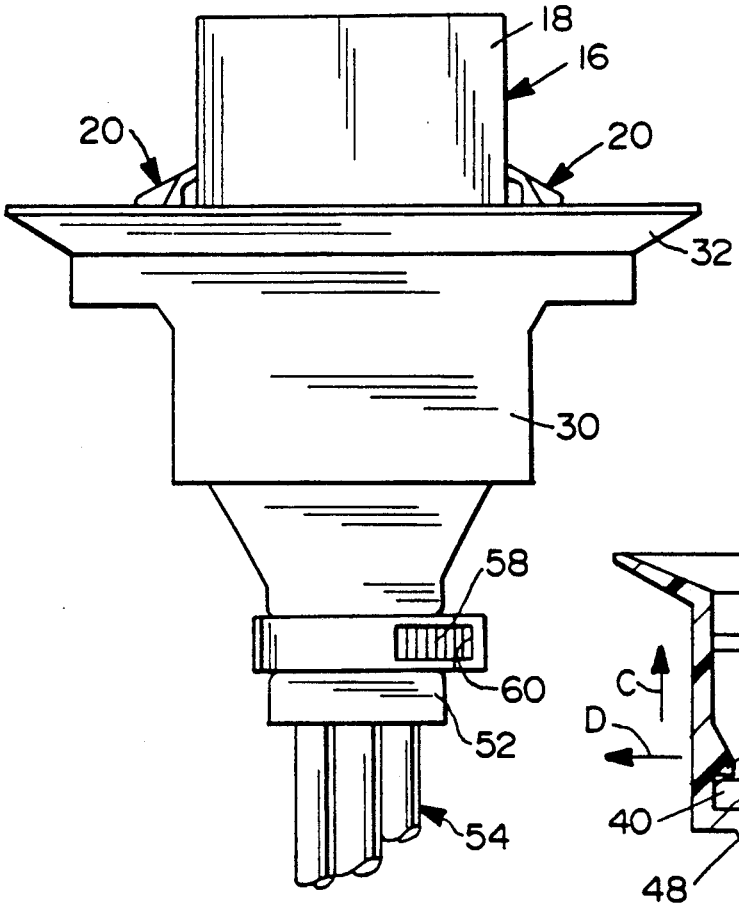
FIG. 1 is an elevational view of the sealing device of the invention positively locked to an electrical connector prior to insertion of the connector through an opening in a panel.

Referring to the drawings in greater detail, a sealing device or boot, generally designated 10, is contemplated by the invention for closing an opening 12 in a panel 14 which accommodates an electrical connector, generally designated 16.

Figure 2:
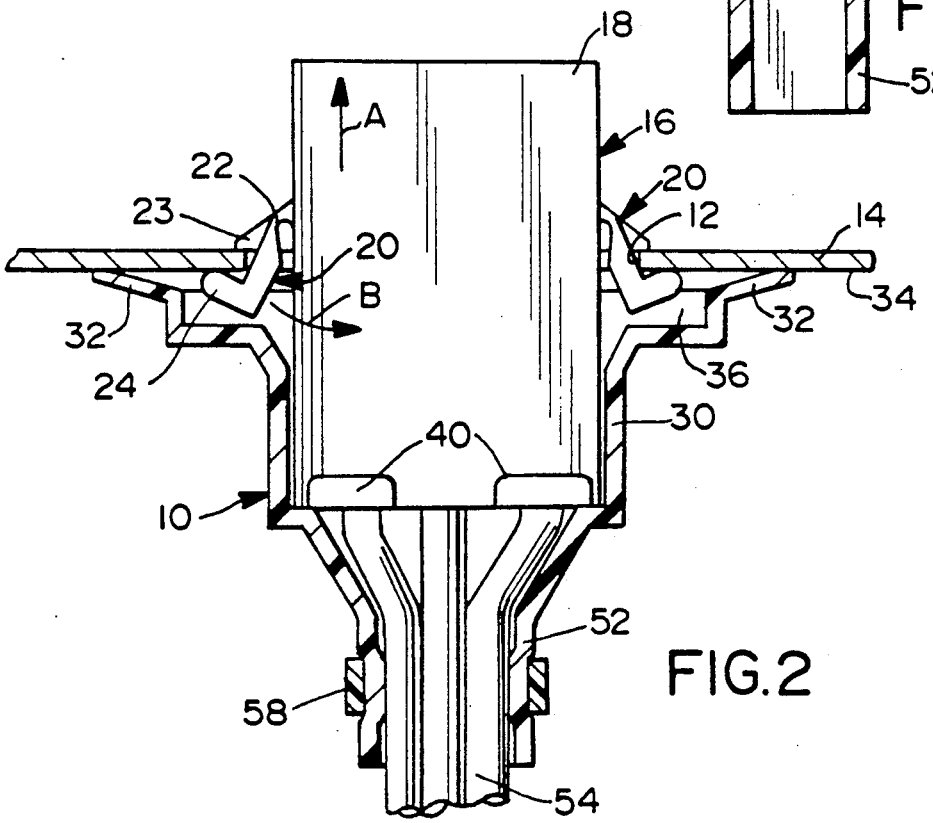
FIG. 2 is a sectional view through the sealing device and a panel, showing the electrical connector in elevation inserted through the panel opening.

As best seen in FIG. 2, electrical connector 16 includes a generally rectangular body 18 having a pair of latching fingers, generally designated 20, for latching the connector to panel 14 within opening 12. Each latching finger has a hinge portion 22 about which the latching finger can pivot. A cam boss 23 projects outwardly from the finger spaced from a latch arm 24, the spacing therebetween being sufficient to receive panel 14, at opening 12, as shown in FIG. 2. When mounting electrical connector 16 through opening 12 in panel 14, the connector is inserted in the direction of arrow "A" (FIG. 2) whereupon cam boss 23 engages the panel at the edge of opening 12 and pivots the latch finger about hinge 22 in the direction of arrow "B" to allow the cam boss to pass through the opening. As the cam boss reaches the opposite side of the opening, the latch finger pivots outwardly, opposite the direction of arrow "B", and arm 24 engages the outside of the panel to prevent further insertion movement. The connector now is securely latched within the opening in the panel.

Figure 3:
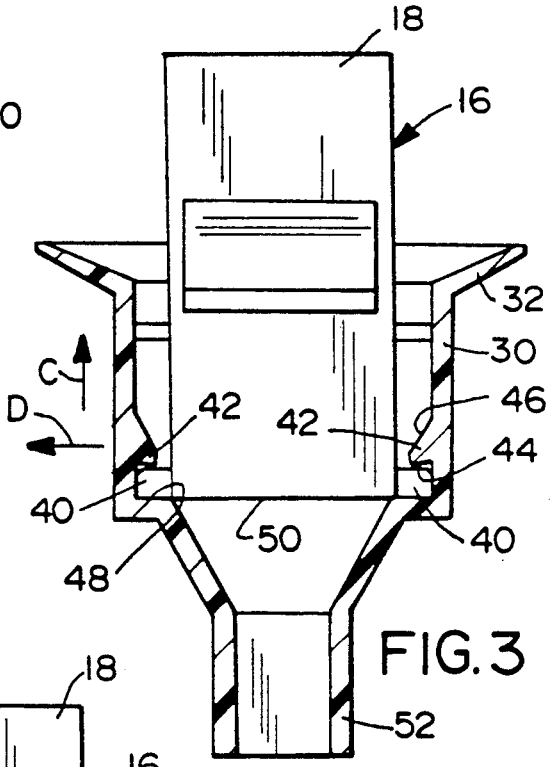
FIG. 3 is a sectional view through the sealing device, with the connector in elevation, and taken at a right-angle to the view of FIG. 2.

Sealing boot 10 includes a body portion 30 positionable about and surrounding body 18 of the connector. The sealing boot is unitarily fabricated or molded of flexible material, such as plastic or rubber, and includes an outwardly directed flexible, peripheral sealing flange 32 for engaging the outside surface 34 of panel 14 about opening 12. The body is generally rectangularly shaped and has generally straight side walls on two sides thereof, as shown in FIG. 3, and stepped side walls on the other two sides as shown in FIG. 2. The stepped side walls provide sufficient space 36 (FIG. 2) to accommodate latching fingers 20 of connector 18. It can be seen in FIGS. 1 and 3 that peripheral sealing flange 32, in its free state, is at an angle relative to panel 14 greater than its angle represented in FIG. 2. This illustrates that the sealing flange is "compressed" against surface 34 (FIG. 2) of the panel to provide a very good seal.

The invention contemplates providing a positive lock between sealing boot 10 and connector 16 in order to maintain the above-described sealing engagement between flexible peripheral flange 32 of the boot and surface 34 of panel 14. This positive lock is particularly useful with connectors having latching means between the connector and the panel, such as latching fingers 20 described above. In other words, with the connector positionally secured relative to the panel, the positive lock between the sealing boot and the connector can maintain the seal between the boot and the panel.

More particularly, connector 18 has a pair of outwardly projecting flanges 40 (FIGS. 2 and 3) on each of two opposite sides thereof As seen in FIG. 3, sealing boot 10 has flanges 42 which are provided with flat surfaces 44 and angled cam surfaces 46. In assembling boot 10 to connector 18, the boot is moved in the direction of arrow "C" (FIG. 3) whereupon angled cam surfaces 46 engage the edge of connector flanges 40 and bias the walls of the boot outwardly in the direction of arrow "D" due to the flexibility of the boot. Further movement of the boot relative to the connector in the direction of arrow "C" causes flanges 42 on the boot to snap behind flanges 40 on the outside of the connector. Flat surfaces 44 of the boot flanges engage behind the flat surfaces the connector flanges to provide a positive lock with flat surfaces 48 on the boot engaging a flat end 50 of the connector. Therefore, with the boot locked to the connector, upon insertion of the connector through opening 12 in panel 14 as described in relation to FIG. 2, peripheral sealing flange 32 of the boot is compressed against surface 34 of the panel to maintain a tight seal therebetween.

Sealing boot 10 also has a tubular portion 52 on the end thereof opposite sealing flange 32 for surrounding a cable, generally designated 54 (FIGS. 1 and 2) interconnected with connector 16. Clamp means in the form of a cable tie 58 (FIGS. 1 and 2) is used for positioning about tubular portion 52 for tightening the tubular portion sealingly about the cable. The cable tie may be in the form of a strap having internal ratchets, with an opening 60 in the strap at one end to receive the opposite end of the strap, the opposite end being pulled through the opening to tighten the strap about the cable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A sealing device for closing an opening in a panel which accommodates an electrical connector, comprising a body positionable about the connector, a sealing flange on the body for sealing engagement with the panel about the opening, and complementary interengaging means between the body and the connector for holding the sealing device in position with the sealing flange in sealing engagement with the panel wherein said complimentary interengaging means includes, a flange means formed on the inside of the body for snapping behind surface means located on the outside of the connector providing a snap-fit of the body on the connector, a connector latch means for engaging the panel at the opening therein said body being of a size sufficient to accommodate the latch means therein, the latch means including at least two latching arms each rotatably mounted on a respective hinge and each including a camming surface for engaging the panel and rotating the arms towards the connector, and wherein said panel is captured between the arms and the camming surfaces, and wherein said body, sealing flange and flange means comprise and integrally molded flexible member and wherein said body has generally straight side wall on two sides thereof and stepped side walls on the other two sides to accommodate said latching means.

2. The sealing device of claim 1 wherein said body has a tubular portion for surrounding a cable interconnected with the connector, and including clamp means about the tubular portion for tightening the tubular portion sealingly about the cable and wherein said body, sealing flange and tubular member comprise an integrally molded flexible member having walls of substantially uniform thickness.

3. The sealing device of claim 1 wherein the device is an integrally molded flexible member.

4. A sealing device for closing an opening in a panel which accommodates an electrical connector, the connector having latch means for engaging the panel at the opening therein, comprising a body portion positionable about the connector and of a size sufficient to accommodate the latch means therewithin, a sealing flange on the body for sealing engagement with the panel about the opening and surrounding the connector and the latch means, and positive lock means between the body and the connector for holding the sealing device in position with the sealing flange in sealing engagement with the panel wherein the sealing device is an integrally molded flexible member and wherein said body and sealing flange have substantially rectangular shapes and said body has generally straight side walls on two sides thereof and stepped side walls on the other two sides to accommodate said latching means.

5. The sealing device of claim 4 wherein said positive lock means include flange means providing a snap fit of the body on the connector wherein said flange means including a substantially flat surface is formed on the inside of the body for snapping behind surface means including a substantially flat surface formed on the outside of the connector whereby the two flat surfaces are formed into a parallel, abutting relationship after the flange means snaps past the surface means.

6. The sealing device of claim 5 wherein said body, sealing flange and flange means comprise an integrally molded flexible member.

* * * * *